United States Patent [19]

Rogers

[11] Patent Number: 5,035,452

[45] Date of Patent: Jul. 30, 1991

[54] VEHICLE DOOR LATCHES

[75] Inventor: Wilfrid D. Rogers, Solihull, England

[73] Assignee: Bomoro, Bocklenberg & Motte GmbH & Co. KG, Wuppertal, Fed. Rep. of Germany

[21] Appl. No.: 447,240

[22] Filed: Dec. 7, 1989

[30] Foreign Application Priority Data

Dec. 17, 1988 [GB] United Kingdom ..... 8829527

[51] Int. Cl.[5] ..... E05B 65/20

[52] U.S. Cl. ..... 292/125; 292/216; 292/225

[58] Field of Search ..... 74/500.5; 292/DIG. 23, 292/DIG. 25, 216, 28, 38, 50, 84, 125, 133, 171, 141, 235, 225

[56] References Cited

U.S. PATENT DOCUMENTS

| | | | |
|---|---|---|---|
| 194,333 | 8/1877 | Cole | 292/125 X |
| 1,753,513 | 4/1930 | Hansen | 292/171 |
| 2,237,658 | 4/1941 | Dyke | 292/225 X |
| 2,507,328 | 5/1950 | Ashley | 292/141 X |
| 2,612,397 | 9/1952 | Stutt | 292/171 X |
| 2,687,320 | 8/1954 | Moler | 292/171 |
| 3,622,188 | 11/1971 | Goeman . | |
| 4,054,307 | 10/1977 | Carella et al. . | |
| 4,080,757 | 3/1978 | Westerman | 292/171 X |
| 4,459,834 | 7/1984 | Seki | 292/DIG. 25 X |
| 4,526,204 | 7/1985 | Primdahl | 74/471 X |
| 4,588,200 | 5/1986 | Kanamori | 74/502 X |
| 4,616,862 | 10/1986 | Ward | 292/201 |

FOREIGN PATENT DOCUMENTS

| | | | |
|---|---|---|---|
| 0169644 | 6/1985 | European Pat. Off. . | |
| 2929967 | 2/1981 | Fed. Rep. of Germany | 292/DIG. 25 |
| 224715 | 10/1987 | Japan | 74/500.5 |
| 1091140 | 11/1967 | United Kingdom . | |
| 1292123 | 10/1972 | United Kingdom . | |
| 2039319 | 8/1980 | United Kingdom | 292/171 |
| 2190697 | 11/1987 | United Kingdom . | |

*Primary Examiner*—Eric K. Nicholson

[57] ABSTRACT

In a cable latch system for a vehicle door, the inside door handle is connected by a single push/pull control cable to a bellcrank lever mounted on the latch housing. The bellcrank lever is itself connected to the locking and release levers of the latch by a vertically disposed spring-loaded push/pull element.

1 Claim, 4 Drawing Sheets

Figure 1
PRIOR ART
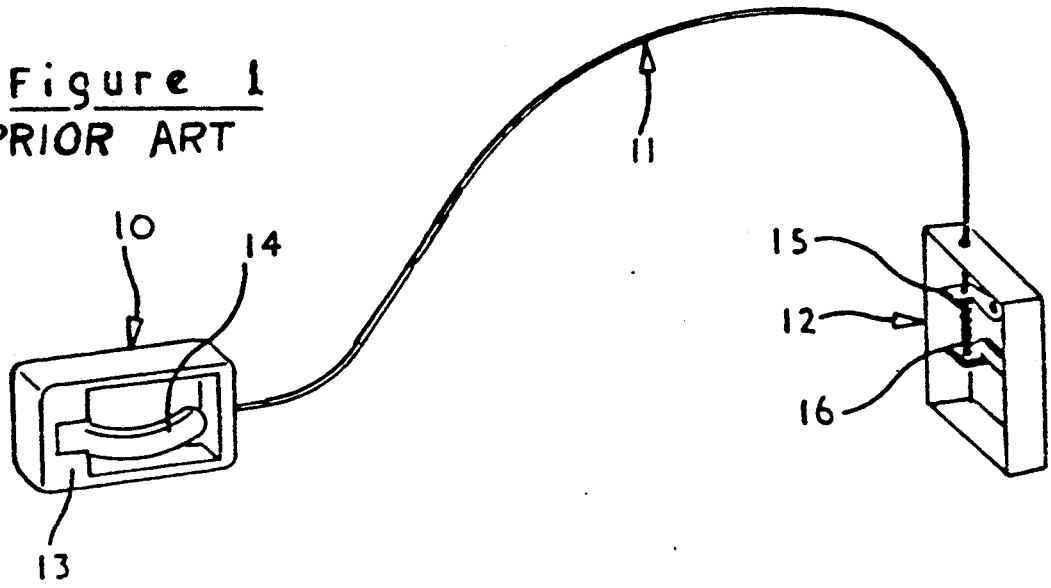
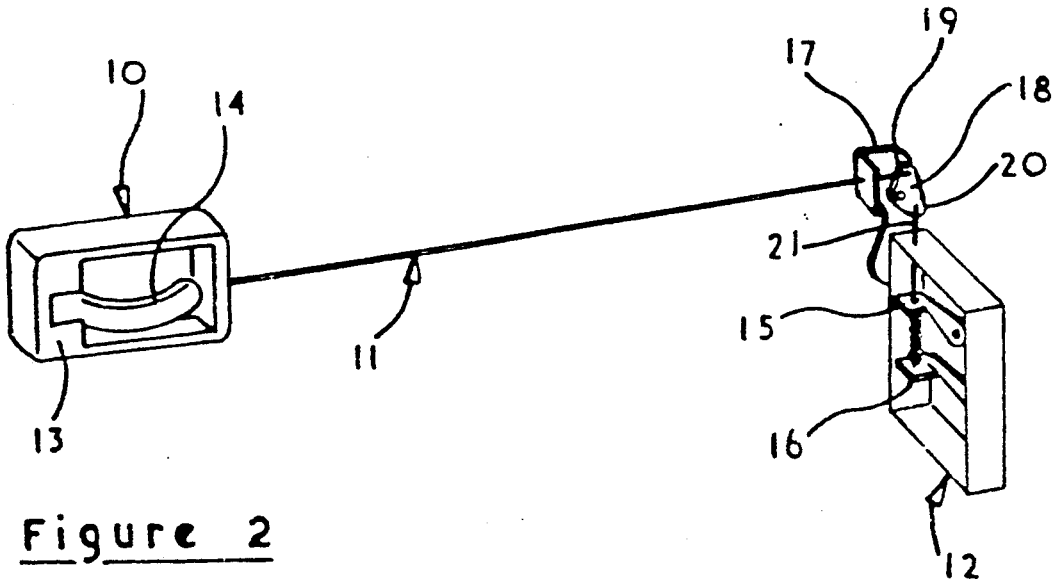
Figure 2

VEHICLE DOOR LATCHES

FIELD OF THE INVENTION

This invention relates to door latches for motor vehicles and, in particular, to means for interconnecting a latch mechanism on a vehicle door with the inner door handle.

BACKGROUND OF THE INVENTION

In European Patent Application No. 0169644 there is described a vehicle door latch system comprising a latch mechanism mounted on a vehicle door and having a release lever operable to release the latch mechanism, and a locking lever having a locked position in which release of the latch mechanism is prevented and an unlocked position in which release of the latch mechanism is enabled: and a handle mounted on the door remote from the latch mechanism and manually operable for releasing, locking and unlocking the latch mechanism, the handle being connected to the latch mechanism by a single push/pull control cable.

In the particular arrangements shown in the drawings of said application, the portion of the cable connected to the latch mechanism is arranged vertically so as to pass through the locking lever for connection to the release lever. However, the portion of the cable connected to the inside door handle extends horizontally, across the door. It is accordingly necessary, at some position within the interior of the door, to bend the cable through approximately 90°.

With the small packaging space available within a vehicle side door, the required bending of the cable may be difficult to achieve. High operating loads may accordingly be required to effect latch locking or release. Functioning of the latch system may thus be somewhat uncertain and, in extreme cases, the available packaging space may be insufficient to accommodate the cable.

It is accordingly an object of the present invention to provide a door latch system which enables the problems referred to above to be overcome.

SUMMARY OF THE INVENTION

According to the present invention there is provided a vehicle door latch system comprising a latch mechanism for mounting on a vehicle door and having a release lever operable to release the latch mechanism and a locking lever having a locked position in which release of the latch mechanism is prevented and an unlocked position in which release of the latch mechanism is enabled: and a handle mounted on the door remote from the latch mechanism and manually operable for releasing, locking and unlocking the latch mechanism, the handle being connected by a single push/pull cable to a bellcrank lever which is connected to the locking and release levers.

The bellcrank lever is preferably mounted on the latch housing and may be disposed other above or below the locking and release levers depending upon the geometry of the latch.

The connection between the bellcrank lever and the locking and release levers preferably comprises a vertically disposed spring-loaded push/pull element, for example, a cable, the cable interconnecting the handle and the bellcrank being disposed substantially horizontally throughout its length without requiring to be bent.

The door latch system of European Patent Application No. 0169644 is such that connection of the cable to the locking and release levers cannot practically be effected adjacent the vehicle assembly line. As a result, the handle, cable and latch are supplied pre-assembled.

This produces a problem in palletising the components being supplied to the assembly line. In, therefore, one form of the present invention, the handle and cable are supplied preassembled and the cable is attached to the bellcrank lever on or adjacent the vehicle assembly line.

According, therefore, to a second aspect of the present invention there is provided a vehicle door latch including a housing for mounting on a vehicle door and having a release lever to release the latch mechanism and a locking lever having a locked position in which release of the latch mechanism is prevented and an unlocked position in which release of the latch mechanism is enabled; and a bellcrank lever mounted on the housing and connected to the locking and release levers by a spring-loaded push-pull element, the bellcrank lever being movable pivotally from an unlocking position in one direction to pull the element to effect release of the latch mechanism and in the other direction to push the element to lock the latch mechanism.

BRIEF DESCRIPTION OF THE DRAWINGS

FIG. 1 illustrates schematically the door latch system of European Patent Application No. 0169644.

FIG. 2 illustrates schematically the door latch system of the present invention.

DESCRIPTION OF THE PREFERRED EMBODIMENTS

Figure 3:
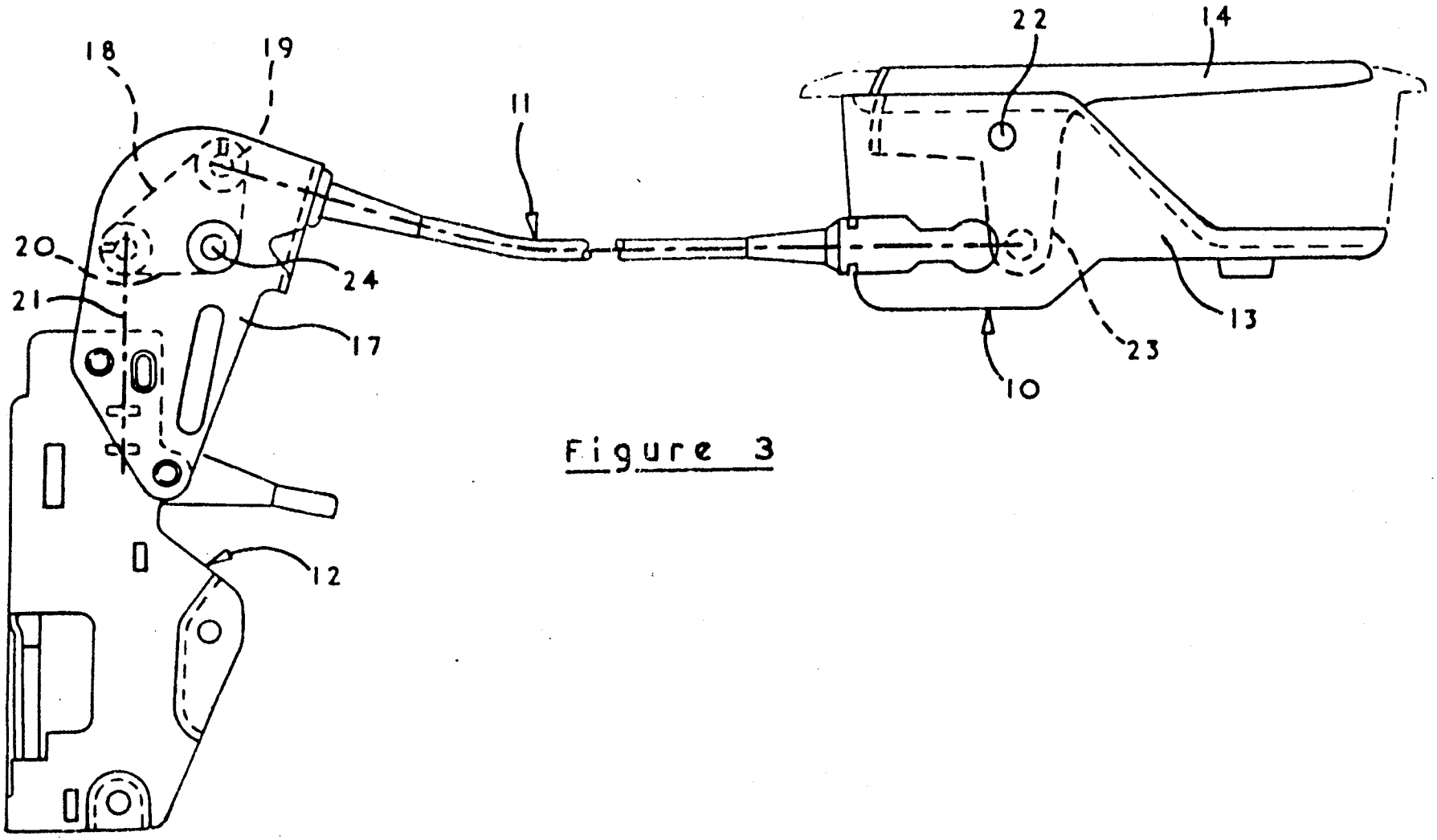
FIG. 3 is a somewhat more detailed illustration of the door latch system of FIG. 2.

The known latch system shown in FIG. 1 comprises a handle 10, a Bowden cable 11 and a latch assembly 12 for mounting on a motor vehicle door in the relative positions shown in FIG. 1. The handle 10 comprises a moulded plastics housing 13 and a pivotally mounted handgrip element 14 connected to the inner element of the Bowden cable in such a manner that manual depression of the handgrip element 14 serves to push the inner cable element to effect a locking operation. Rotation of the handgrip element 14 in the opposite direction serves to pull on the inner cable element to release the latch.

As shown in FIG. 1, that part of the Bowden cable 11 connected to the handle 11 is disposed horizontally whereas that portion of the Bowden cable 11 connected to the latch assembly 12 is disposed vertically. The bending of the Bowden cable 11 in the manner illustrated in FIG. 1 can create packaging problems within the confines of a vehicle door and, if acute bending of the cable is effected, this can seriously affect the "feel" of the latch and, in extreme cases, the functioning of the latch. Connection of the inner element of the Bowden cable 11 to the locking lever 15 and release lever 16 is effected in the manner illustrated in FIG. 3A of the drawings of European Patent Application No. 0169644, to which reference should be made.

FIG. 2 shows the latch system of the present invention, like parts being referred to by the same reference numerals used in FIG. 1. A bracket 17 is mounted on the latch housing and carries a bellcrank lever 18. The cable 11 is attached to one 19 of the arms of the bellcrank lever 18 and the other arm 20 of the bellcrank lever 18 is connected by a spring-loaded push-pull control cable 21 to the locking and release levers 15 and 16. The manner of operation of the latch assembly is as described in European Patent Application No. 0169644.

Turning next to FIG. 3, this shows the latch system of FIG. 2 in more detail and the same reference numerals are again employed to indicate like parts of the system. The handgrip element 14 has a pivotal mounting at 22 and can be moved either clockwise or anti-clockwise from the position shown in FIG. 3. The handgrip element 14 is formed integrally with an arm 23 to which the inner element of the Bowden cable 11 is attached. Clockwise movement of the handgrip element 14, i.e. movement inwardly of the door panel on which the handle 10 is mounted, serves to push the cable element to the left as viewed in FIG. 3.

The bellcrank lever 18 is pivotally mounted at 24 on the bracket 17 so that, as the cable inner element is moved to the left as viewed in FIG. 3, the bellcrank lever 18 is caused to pivot in an anti-clockwise direction about its pivot mounting 24 so that a downward force is applied to the push-pull cable connected to the locking and release levers 15 and 16. A locking action is thus obtained, just as described in European Patent Application No. 0169644.

As will be appreciated, however, horizontal movement of the inner element of the Bowden cable 11 is translated into vertical movement of the control cable 21 without any significant bending of the cables being involved. This significantly improves the "feel" of the latch, simplifies packaging of the latch system within the available space inside the door panel and avoids excessive loading of the cable.

In like manner, when the handgrip element 14 is moved in an anti-clockwise direction, i.e. outwardly of the door panel, the inner element of the Bowden cable 11 is pulled to the right as viewed in FIG. 3. This causes the bellcrank lever 18 to be rotated in an anti-clockwise direction to apply an upwardly directed pull to the cable 21 to release the latch.

Connection of the Bowden cable 11 to the latch assembly involves attachment of the cable inner element to the bellcrank lever 18 and the sheath or outer element to a fixture on the bracket 17. Such attachment operations can be effected, if required, at a position on or adjacent the vehicle assembly line. The latch assembly 12 can thus be despatched to the vehicle assembly line separately from the handle 10 and cable 11. Palletisation of the latch components can thus be simplified as compared to the latch system of European Patent Application No. 0169644.

A separate latch assembly having the features described above is shown in FIGS. 4 and 5 and the same reference numerals are again employed to indicate like parts of the latch. It is to be noted, however, that the bellcrank lever 18 of FIGS. 4 and 5 is disposed beneath the locking and release levers 15 and 16 whereas, in the system of FIGS. 2 and 3, the bellcrank lever 18 is disposed above the locking and release levers 15 and 16.

Figure 4:
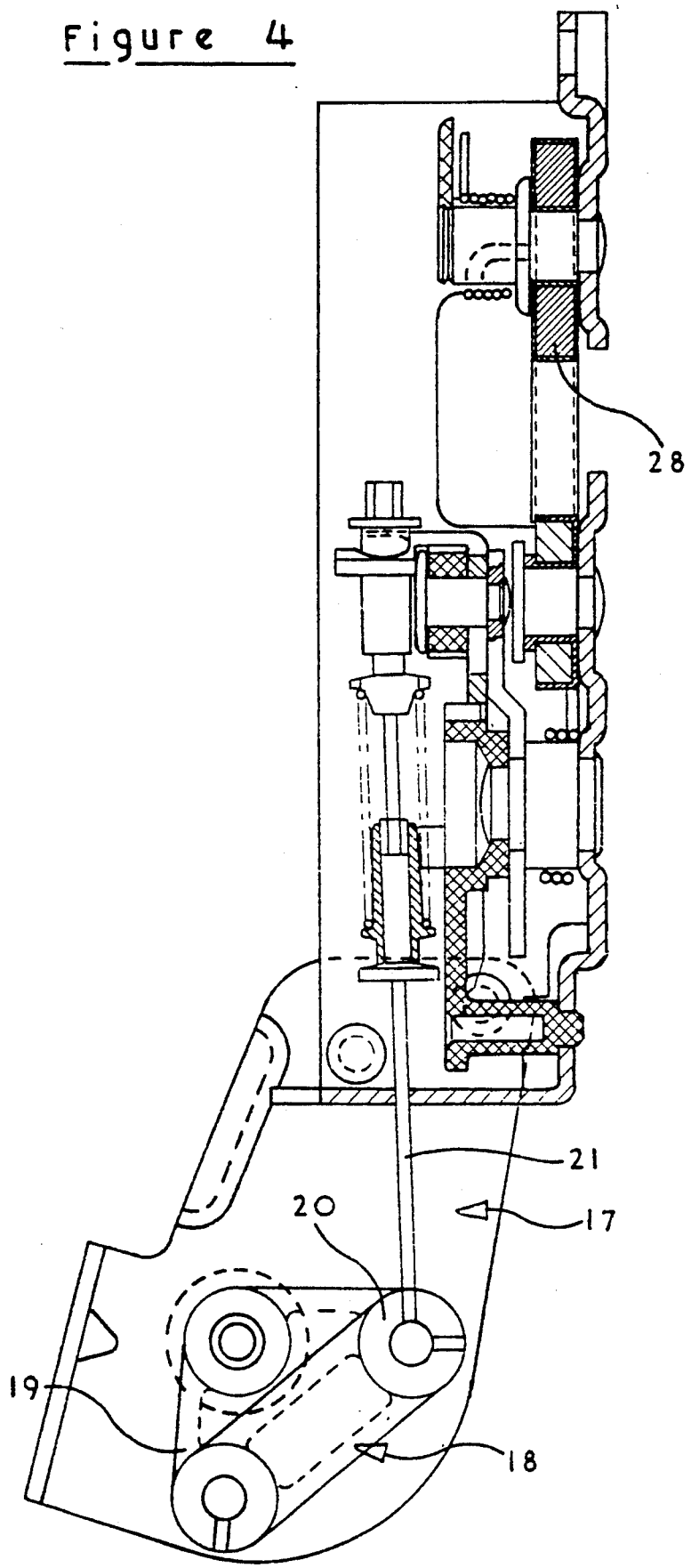
FIG. 4 is a vertical sectional view of a door latch in accordance with the second aspect of the invention.
Figure 5:
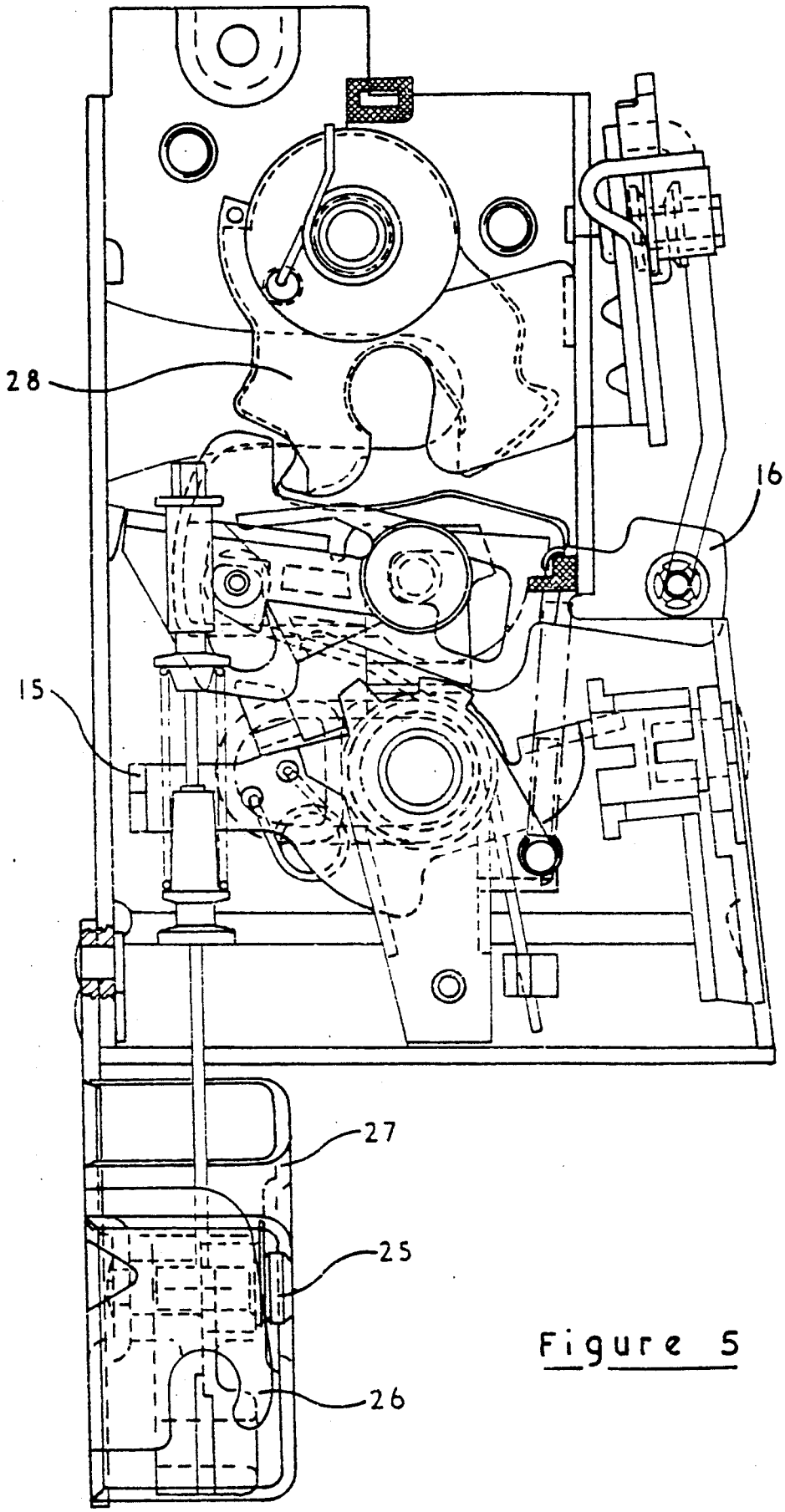
FIG. 5 is a view of the latch of FIG. 4 taken at right angles to FIG. 4.

As shown in FIGS. 4 and 5, the bellcrank lever 18 is pivotally mounted, by means of a stepped rivet 25, on the bracket or back plate 17. One arm 20 of the bellcrank lever 18 terminates in a cylindrical socket formation which receives an end fitting of the vertical cable 21 which extends upwardly to the locking and release levers 15 and 16. The other arm 19 of the bellcrank lever 18 terminates in a like cylindrical socket formation to which the inner element of a Bowden cable mechanism, corresponding to the Bowden cable 11 of FIGS. 2 and 3, can be attached. The outer element of the Bowden cable mechanism is anchored to a jaw formation 26 provided by part of the back plate 17.

The bellcrank lever 18 is formed as a plastics moulding from a polyacetal resin and is located between the back plate 17 and a bellcrank holder 27 which protects and supports the bellcrank lever 18. The holder 27 is also formed as a plastics moulding from a polyacetal resin. It includes a recessed portion within which the head of the stepped rivet 25 is located such that the end face of the rivet 25 is flush with the presented face of the holder 27 and presents a clean line.

The mode of operation of the latch of FIGS. 4 and 5, including movement of the locking and release levers 15 and 16 between the positions corresponding to locking, unlocking and release of the latch bolt 28, is as described in European Patent Application No. 0169644 mentioned above.

Important advantages of the latch shown in FIGS. 4 and 5 as compared to the latch of said European application are that the latch can be packaged more effectively in a restricted space, the "feel" of the latch is improved as a result of the Bowden cable 11 not being subjected to substantial bending, and the installation of the latch in the vehicle door is facilitated.

I claim:

1. A vehicle door latch including a housing for mounting on a vehicle door and having a release lever operable to release the latch mechanism and a locking lever having a locked position in which release of the latch mechanism is prevented; and a bell crank lever mounted on the housing and connected to the locking and release levers by a spring-loaded push/pull element, the push/pull element being arranged vertically and the bellcrank lever being movable from an unlocking position in one direction to pull the element to effect release of the latch mechanism and in the other direction to push the element to lock the latch mechanism, the bellcrank lever being provided with means for attachment of a cable for operation by the door handle, and the bellcrank lever being arranged for rotation about the axis of a pin extending between a support bracket attached to the latch housing and a holder for the bellcrank lever, which holder is formed with a recess within which a head on the pin is received.

* * * * *